US007506653B2

(12) United States Patent
Gladwin et al.

(10) Patent No.: US 7,506,653 B2
(45) Date of Patent: Mar. 24, 2009

(54) HAIR CLIP WITH INTERLOCKING COMBS

(76) Inventors: Thea Gladwin, 119 Hans Strydom Drive, Robin Hills, 2194, Randburg (ZA); Richard George Gladwin, 119 Hans Strydom Drive, Robin Hills, 2194, Randburg (ZA)

( * ) Notice: Subject to any disclaimer, the term of this patent is extended or adjusted under 35 U.S.C. 154(b) by 0 days.

(21) Appl. No.: 10/559,679

(22) PCT Filed: Jun. 21, 2004

(86) PCT No.: PCT/ZA2004/000068

§ 371 (c)(1),
(2), (4) Date: Dec. 6, 2005

(87) PCT Pub. No.: WO2004/112532

PCT Pub. Date: Dec. 29, 2004

(65) Prior Publication Data

US 2006/0196521 A1 Sep. 7, 2006

(30) Foreign Application Priority Data

Jun. 20, 2003 (ZA) ..... 03/4784
Mar. 16, 2004 (ZA) ..... 04/2081

(51) Int. Cl.
*A45D 24/04* (2006.01)
*A45D 8/00* (2006.01)

(52) U.S. Cl. ..... 132/128; 132/273

(58) Field of Classification Search ..... 132/128, 132/126, 138, 148, 219, 144
See application file for complete search history.

(56) References Cited

U.S. PATENT DOCUMENTS

| | | | | | |
|---|---|---|---|---|---|
| 184,793 | A | * | 11/1876 | Morse | 132/128 |
| RE16,546 | E | * | 2/1927 | Parker | 132/131 |
| 1,635,065 | A | * | 7/1927 | Watson | 132/128 |
| 1,665,380 | A | * | 4/1928 | Ruffio | 132/105 |
| 1,977,920 | A | * | 10/1934 | Robinson | 132/128 |
| 5,690,128 | A | | 11/1997 | Grimes | |
| 6,047,705 | A | | 4/2000 | Hawley | |
| 6,123,086 | A | | 9/2000 | Kuglen | |
| 6,427,702 | B1 | | 8/2002 | Silva | |
| D483,522 | S | * | 12/2003 | Leslie | D28/33 |

* cited by examiner

*Primary Examiner*—Robyn Doan
(74) *Attorney, Agent, or Firm*—Jones, Tullar & Cooper, P.C.

(57) ABSTRACT

The hair clip comprises two combs and at least one elastic member to bias the teeth of the combs toward each other in overlapping relationship. The teeth of the combs are similar and are at least slightly wider than the spaces between the teeth. In use, the combs may be twisted relatively to each other while inserting them into engagement, such that some of the teeth of one comb overlay and others underlay the teeth of the other combs so as to clamp hair between the two combs. Preferably the teeth are oval or elliptical in cross-section, such that they interfit partially with the teeth with which they are engaged.

8 Claims, 3 Drawing Sheets

HAIR CLIP WITH INTERLOCKING COMBS

This is a filing under 35 U.S.C. 371 of PCT/ZA2004/000068, filed Jun. 21, 2004, which claims priority from South African Application Serial No. 2003/4784 filed Jun. 20, 2003 and South African Application Serial No. 2004/2081 filed Mar. 16, 2004. PCT/ZA2004/000068 has been published as International Publication Number WO 2004/112532, and the publication is in English.

TECHNICAL FIELD

This invention relates to hair clips or fasteners comprising two combs and at least one elastic member resiliently to bias the teeth of the combs into an interleaved arrangement with one another. The invention is concerned primarily, though not exclusively, with hair clips having combs that are movable independently of each other.

BACKGROUND ART

Known hair clips with two combs, of all types, rely on the resilient bias of the elastic member and the configuration of the clips (or clips and elastic member) to hold the clip in engagement with the user's hair. Thus such clips do not reliably engage sparse, short or small clumps of hair as there is limited, if any, engagement of the teeth with individual hairs or clumps of hair.

This invention seeks to provide a hair clip for reliably engaging all types, lengths and quantities of hair.

DISCLOSURE OF THE INVENTION

One aspect of the invention provides a hair clip comprising two combs and at least one elastic member resiliently to bias the teeth of the combs into an interleaved arrangement with one another, wherein at least selected teeth are wider than the spaces between teeth with which such selected teeth are to be interleaved in use and the teeth of each comb are shaped to fit at least partially into the spaces between the teeth of the other comb.

This construction causes interleaved teeth to overlap one another and clamp hair between one another.

The teeth of each comb may be similar to one another, in which event preferably all of the teeth are wider than the spaces between the teeth.

Preferably the width of the teeth is about 0.5 to 2 mm wider than the width of the spaces. This causes an overlap in the range of 0.5 to 2 mm.

The combs may be of a resiliently flexible material, such as an appropriate plastics.

Another aspect of the invention provides a method of clipping hair using a hair clip comprising two combs and at least one elastic member to bias the teeth of the combs towards one another, the combs being movable independently of each other and selected teeth being wider than the spaces between teeth with which such selected teeth are to be interleaved in use, including the steps of:

- inserting one of the combs into the hair in a first direction;
- stretching the elastic member;
- inserting the other comb into the hair in a second direction substantially opposed to the first direction; and
- twisting or bending at least some of the teeth while inserting the combs into engagement with each other to cause some of the teeth of one comb to overlay and others to underlay the teeth of the other comb and thereby resiliently clamp hair between the two combs.

The combs may rotated relatively to each other or some of the teeth of one or each comb may be bent away from the general plane of the other teeth of that comb.

Further features, variants and/or advantages of the invention will emerge from the following non-limiting description of examples of the invention made with reference to the accompanying schematic drawings and from the claims, which are to be regarded as an integral part of this description.

DESCRIPTION OF ILLUSTRATED EMBODIMENTS

Figure 1:
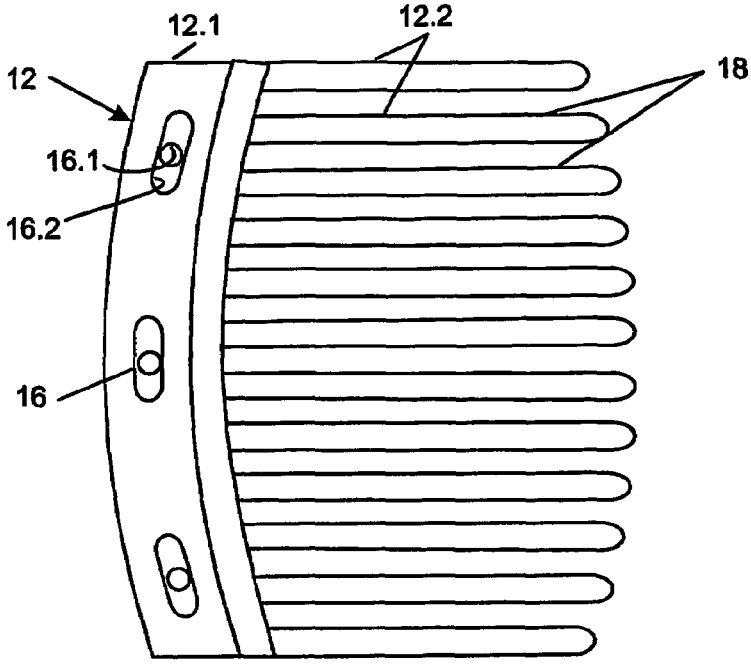
FIG. 1 shows a plan view of a comb for a hair clip of the invention.

In the drawings the same or similar parts have the same reference numbers, certain parts having sub-numbers to identify them as part of a component or as substantially equivalent parts in different embodiments.

Figure 2:
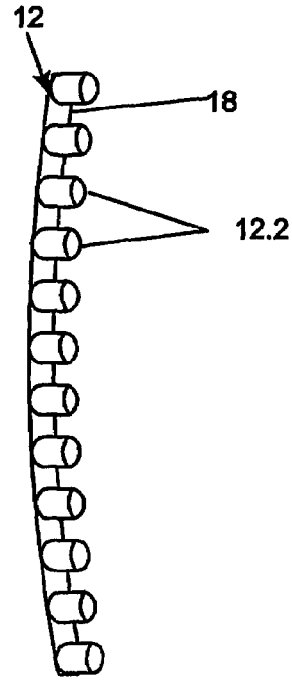
FIG. 2 shows an end view of the comb of FIG. 1.
Figure 3:
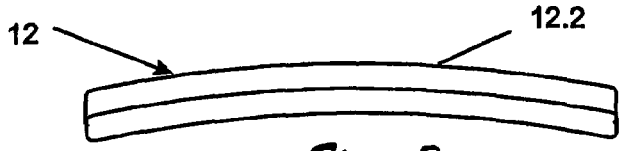
FIG. 3 shows a side view of the comb of FIG. 1.
Figure 11:
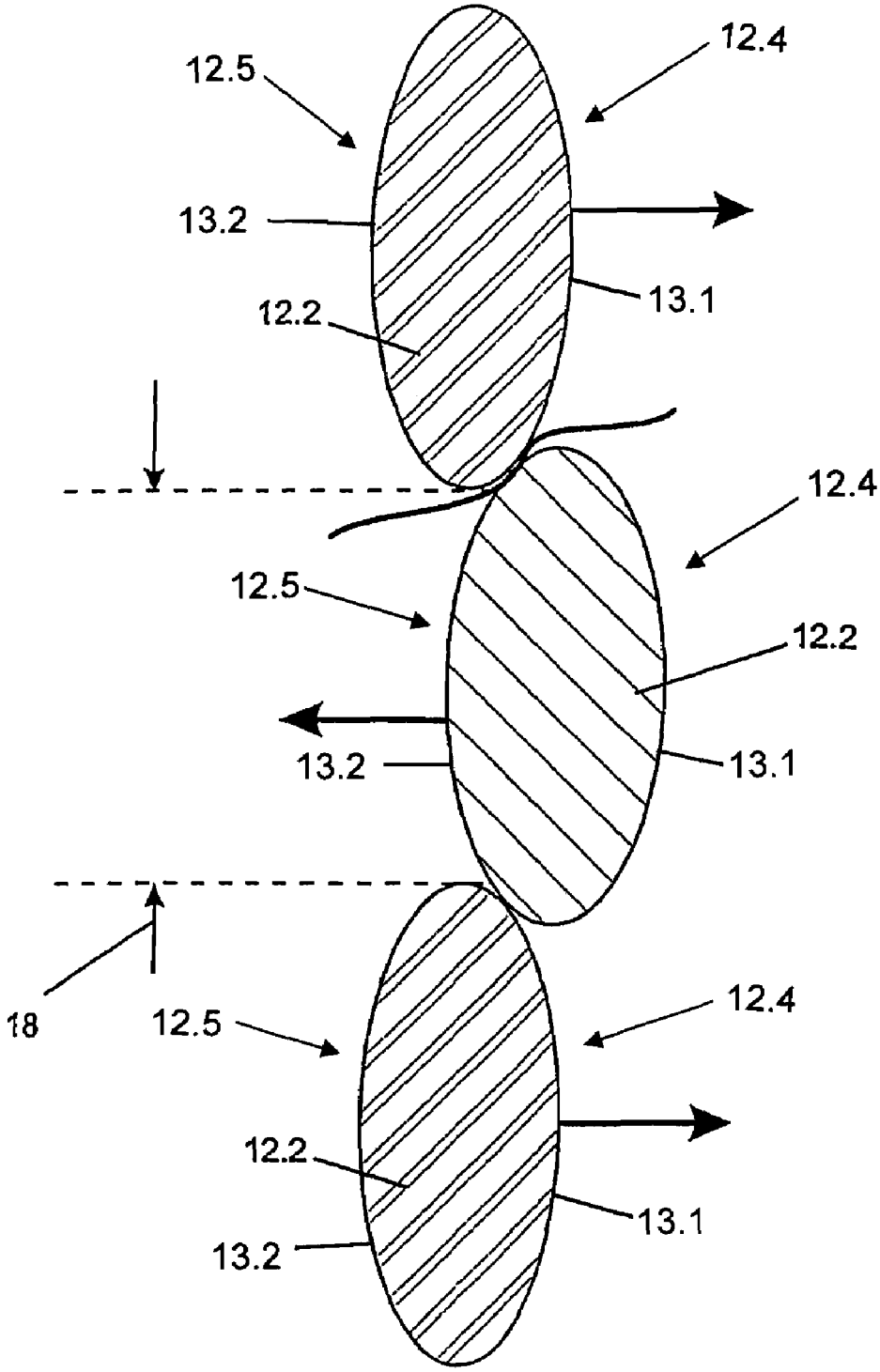
FIG. 11 shows, on an enlarged scale, a cross-section of teeth of interleaved combs of the invention illustrating how hair is clamped in use.

FIGS. 1 to 3 of the drawings show a hair clip 10 comprising two combs 12 and three elastic members 14 connecting the combs to each other. Each comb 12 has a back 12.1 formed with three through holes 16.1, each recessed in a slot 16.2, for attaching one end of an elastic member 14 and a plurality of similar teeth 12.2 that are separated from one another by spaces 18. The comb is curved in three dimensions, i.e. in plan, side and end views, so that it can follow the curvature of the head of a user. Each comb is injection moulded of a resiliently flexible Nylon. As best seen in FIG. 11, each tooth is elliptical in cross-section and has a width that it slightly greater than the spaces 18 between the teeth. The teeth of each comb are shaped with a first tapering side 13.1 on a first surface 12.4 and a second tapering side 13.2 on a second surface 12.5.

Two of the elastic members 14.1 comprises a loop of elasticised strip material within a material sleeve 15 that has a length much greater than the loop when unstretched so that it bunches around the loop. The central elastic member 14.2 comprises a plurality of beads 17 threaded onto on elasticised loop.

In the illustrated embodiment the teeth have a width of about 4 mm and the spaces are each about 3.5 mm wide. The teeth may be much thinner, such as 2 mm wide, with correspondingly narrower spaces. In any event, the width of the teeth is slightly greater than that of the spaces by 0.5 to 2 mm.

Figure 4:
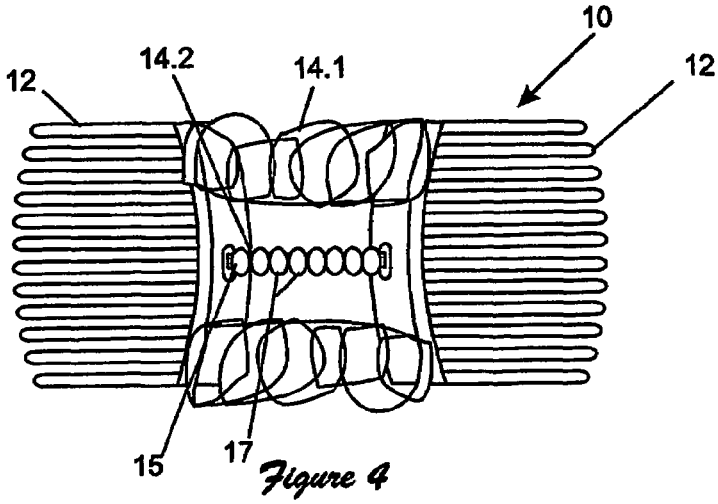
FIG. 4 shows a plan view of a hair clip of the invention including to combs as shown in FIG. 1.
Figure 5:
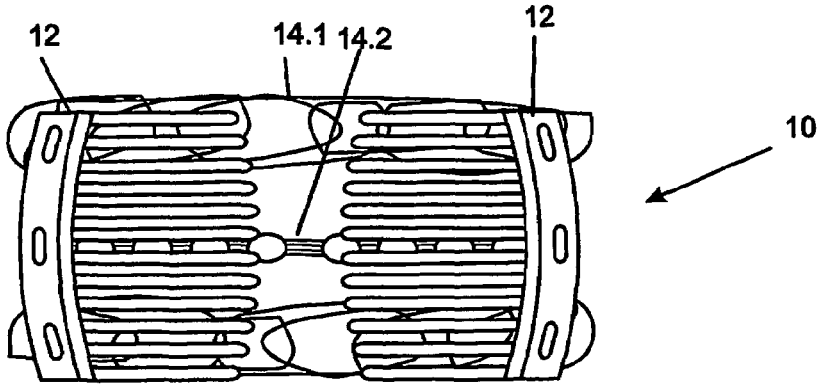
FIG. 5 shows an underplan view of the hair clip of FIG. 4, the combs being arranged ready for use.
Figure 6:
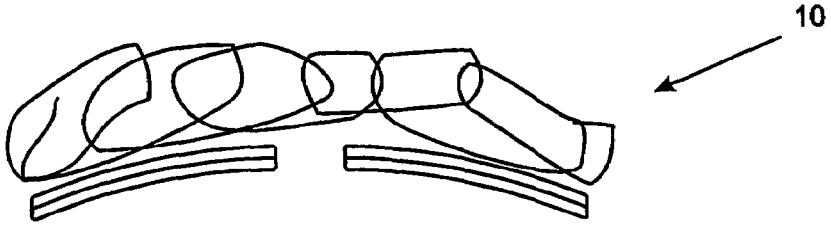
FIG. 6 shows a side view of the clip of FIG. 5.

FIG. 4 shows the clip 10 in its relaxed position with the teeth of the two combs facing away from one another. FIGS. 5 and 6 show the clip with the teeth facing each other ready for use.

In use, one of the clips is inserted into the user's hair, the elastic members 14 are stretched and the other comb is inserted into the hair in a direction towards the first comb. The combs are then pushed together, with hair to be fastened contained within the space between the combs and the elastic members. The combs are drawn together by the elasticity of the elastic members. The combs are also locked into the hair to some extent in the conventional manner by the teeth interengaging the hair into which it is pushed.

Figure 7:
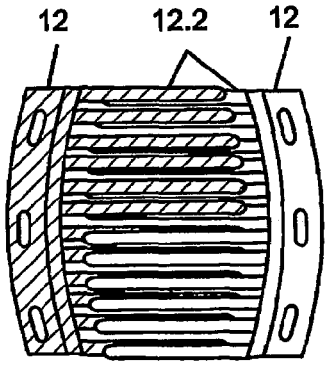
FIG. 7 shows the combs of the clip of FIG. 5 engaged with each other in a first configuration.
Figure 8:
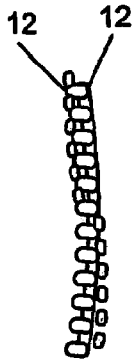
FIG. 8 shows a sectioned view along VIII-VIII of the combs of FIG. 7.

In accordance with the invention, the comb inserted second is twisted, ie. rotated, by about 15° prior to insertion into engagement with the comb that has already been inserted into the hair. This results in the configurations shown in FIGS. 7 and 8 in which one part of each comb overlays a part of the other comb. As shown in the Figures, the hair clip has a first comb with first-comb teeth separated by first-comb spaces and a second comb having second-comb teeth separated by second-comb spaces. The width of the first-comb teeth are slightly wider than the width of the second-comb spaces and the width of the second-comb teeth are slightly wider than the width of the first-comb spaces such that only a portion of teeth from each comb can fit into the spaces of the opposite comb. Consequently strands of hair are clamped between the two combs, because the teeth are wider than the spaces and engage one another as shown in FIG. 11. This clamping action ensures clamping of sparse, thin, short and small clumps or strands of hair.

Figure 9:
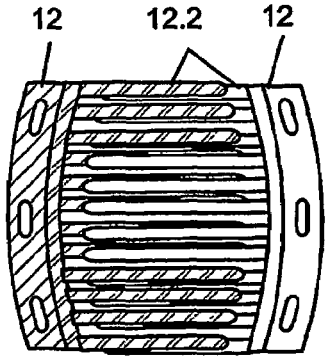
FIG. 9 shows the combs of the clip of FIG. 5 engaged with each other in a second configuration.
Figure 10:
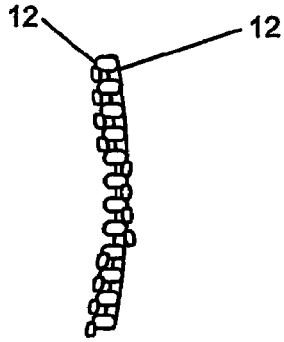
FIG. 10 shows a sectioned view along IX-IX an end view of the combs of FIG. 9.

FIGS. 9 and 10 show an alternative use of the clip 10, in which one of the combs is flattened in a direction normal to the back 12.1 when the combs are pushed into engagement with each Other. Thus, when engaged, the teeth of two spaced portions of one comb overlay the other comb. This creates a tighter clamping action than the arrangement of FIGS. 7 and 8, because the elasticity of the material of the combs themselves is also applied to urge the teeth of one comb towards those of the other comb.

The elastic members are not shown in FIGS. 7 to 10 for clarity of illustration. For the same reason hatching is applied to one of the combs to assist in distinguishing the teeth of the respective combs.

The invention is not limited to the precise details described above and shown in the drawings. Modifications may be made and other embodiments developed without departing from the scope of the invention as defined in the claims. For example, any suitable resiliently flexible plastics, such as polypropylene, polyethylene, ABS plastics may also be used. The comb may be of any desired size, length and width as desired. The elastic members can be used in any desired combination, such as all material covered or all beaded, none covered, different combinations and arrangements of beads, and so on.

The invention claimed is:

1. A hair clip which includes a first comb having first-comb teeth separated by first-comb spaces and a second comb having second-comb teeth separated by second-comb spaces and at least one elastic member resiliently to bias teeth of each comb into an interleaved arrangement with one another, each comb having opposed first and second surfaces, wherein:

a) the width of the first-comb teeth are slightly wider than the width of the second-comb spaces and the width of the second-comb teeth are slightly wider than the width of the first-comb spaces b) the first-comb teeth and the second-comb teeth are each shaped with tapering sides on both first and second surfaces thereof in order to inter-fit with the teeth of the other comb, such that only a portion of at least selected teeth of said fist-comb teeth fit partially into said second-comb spaces and only a portion of at least selected teeth of said second-comb teeth fit partially into said first-comb spaces; and c) the teeth are substantially elliptical in cross-section to provide the tapering sides substantially along their length, whereby, when the teeth of the combs are interleaved from opposite directions, with some of the teeth of one comb overlaying and others underlaying the teeth of the other comb and such teeth being biased towards one another, at least some of such overlaying and underlaying teeth interact with one another to form clamps for clamping hair between the two combs in use.

2. A hair clip according to claim 1 wherein all of the teeth are wider that the spaces between the teeth and all are of substantially the same width.

3. A hair clip according to claim 1 wherein the width of the first-comb teeth is about 0.5 to 2 mm wider than the width of the second-comb spaces with which the first-comb teeth are to be interleaved in use and wherein the width of the second-comb teeth is about 0.5 to 2 mm wider than the width of the first-comb spaces with which the second-comb teeth are to be interleaved in use.

4. A hair clip according to claim 1 wherein the combs are made of a resiliently flexible material.

5. A hair clip according to claim 1 wherein the elastic member includes a length of elastic material and a plurality of beads threaded onto the length of elastic material.

6. A method of fastening hair using a hair clip which has two combs and at least one elastic member to bias teeth of the combs towards each other, the combs being movable independently of each other and selected teeth of the combs being wider that spaces between teeth with which such selected teeth are to be interleaved in use, which includes the steps of:

(A) inserting one of the combs into the hair in a first direction;

(B) stretching the elastic member;

(C) inserting the other comb into the hair in a second direction substantially opposed to the first direction; and (D) twisting the combs relatively to each other while inserting them into engagement, such that some of the teeth of one comb overlay and others underlay the teeth of the other comb so as to clamp hair between the two combs.

7. A method according to claim 6 wherein the twisting is performed by rotating one comb relatively to the other.

8. A method according to claim 6 wherein the twisting is performed by distorting at least one combs about an axis substantially parallel to the length of the teeth of the comb.

* * * * *